US008123490B2

(12) United States Patent
Goto et al.

(10) Patent No.: US 8,123,490 B2
(45) Date of Patent: Feb. 28, 2012

(54) APPARATUS AND METHOD FOR CONTROLLING ELECTRIC COMPRESSOR

(75) Inventors: Masahiro Goto, Aichi-ken (JP); Koji Nakano, Aichi-ken (JP); Takashi Nakagami, Aichi-ken (JP); Makoto Hattori, Aichi-ken (JP); Takayuki Takashige, Aichi-ken (JP); Kazuki Niwa, Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 432 days.

(21) Appl. No.: 12/439,649

(22) PCT Filed: Sep. 28, 2007

(86) PCT No.: PCT/JP2007/069097

§ 371 (c)(1),
(2), (4) Date: Mar. 2, 2009

(87) PCT Pub. No.: WO2008/108021

PCT Pub. Date: Sep. 12, 2008

(65) Prior Publication Data

US 2009/0263255 A1 Oct. 22, 2009

(30) Foreign Application Priority Data

Mar. 6, 2007 (JP) ..... 2007-055208

(51) Int. Cl.
*F04B 49/06* (2006.01)

(52) U.S. Cl. ..... 417/44.2; 417/44.1

(58) Field of Classification Search ..... None
See application file for complete search history.

(56) References Cited

U.S. PATENT DOCUMENTS 5,253,481 A 10/1993 Takagi et al.

FOREIGN PATENT DOCUMENTS

| | | | |
|---|---|---|---|
| JP | 5099165 | A | 4/1993 |
| JP | 2508191 | B2 | 6/1996 |
| JP | 10227533 | A | 8/1998 |
| JP | 2921426 | B2 | 7/1999 |
| JP | 3125614 | B2 | 1/2001 |
| JP | 2006-029342 | A | 2/2006 |

OTHER PUBLICATIONS

Machine translation of JP 2921426 B2.*

(Continued)

*Primary Examiner* — Toan Ton
*Assistant Examiner* — Britt D Hanley
(74) *Attorney, Agent, or Firm* — Westerman, Hattori, Daniels & Adrian, LLP

(57) ABSTRACT

There is provided an apparatus for controlling an electric compressor, which can actuate the electric compressor rapidly through a simpler and lower-cost configuration while achieving reduction in weight, cost, and assembling time of the electric compressor. In the case where a pressure difference between the inlet side and the outlet side of the compressor body is present when a motor of the electric compressor is actuated, the motor is actuated at a number of revolutions lower than that in the normal mode. Thereby, even if a refrigerant has been liquefied on the outlet side of the compressor body, for example, the motor can be actuated by performing such action as to push out the liquefied refrigerant. In this case, the number of revolutions of the motor is increased by being changed stepwise or linearly, by which the number of revolutions of the motor is caused to reach a required number of revolutions as early as possible while surely performing the actuation.

4 Claims, 3 Drawing Sheets

OTHER PUBLICATIONS

Machine translation of JP 3125614 B2.*
Machine translation of JP 10-227533 A.*
International Search Report of PCT/JP2007/069097; Mailing Date of Nov. 27, 2007.

* cited by examiner

APPARATUS AND METHOD FOR CONTROLLING ELECTRIC COMPRESSOR

TECHNICAL FIELD

The present invention relates to an apparatus and method for controlling an electric compressor constituting an air conditioner.

BACKGROUND OF ART

Conventionally, in an automotive air conditioner, the driving force of an automotive engine has been used to drive a compressor for compressing a refrigerant. However, with the recent practical use of electric vehicles and the like, what is called an electric compressor, in which an electric motor is used as a driving source for the compressor, has been developed.

In such an electric compressor, since the driving torque produced by the motor is lower than that produced by an engine, if the pressure difference of refrigerant between the inlet side and the outlet side of the compressor is large especially at the time of actuation, there is a possibility that the compressor cannot be actuated. The reason for this is that the motor load that tends to actuate the compressor becomes excessive because of the large pressure difference, so that, in a motor drive control circuit, an overcurrent protecting function for protecting the motor is triggered.

To solve this problem, a technique has been proposed that there is provided a differential pressure sensor for detecting the pressure difference between the inlet side and the outlet side of the compressor, and a threshold value for judging whether or not the current flowing in the motor when the compressor is actuated is changed according to the detection value of the differential pressure sensor, or a voltage applied to the motor is controlled (for example, refer to Patent Document 1).

Patent Document 1: Japanese Patent Laid-Open No. 2006-29342

DISCLOSURE OF THE INVENTION

Problems to be Solved by the Invention

However, in the technique proposed in Patent Document 1, the control is complicated, and the differential pressure sensor is needed, which leads to an increase in weight, cost, and assembling time caused by the increase in the number of parts of electric compressor. Also, if the differential pressure sensor fails, the function cannot be performed, which provides room for improvement in reliability.

Also, depending on the operating condition at the time when the air conditioner is stopped, the pressure difference of refrigerant between the inlet side and the outlet side of the compressor is sometimes large. Further, in the case where a long period of time has elapsed after the air conditioner has been stopped, the refrigerant gas on the outlet side turns from a gas state to a liquid state, so that liquid compression may provide motor overload. In such a case, in the conventional technique, much time is required from when the compressor is actuated to when the air conditioner is operated normally. In particular, the automotive air conditioner has a need for the compressor to be actuated rapidly because it is to be desired that the air conditioner be operated strongly immediately after the startup of the compressor. Therefore, in any case, it is desired to actuate the compressor rapidly. In this respect, there is room for further improvement.

The present invention has been accomplished to solve the above technical problems, and accordingly an object thereof is to provide an apparatus and method for controlling an electric compressor, in which an electric compressor can be actuated rapidly through a simpler and lower-cost configuration while achieving reduction in weight, cost, and assembling time of the electric compressor.

Means for Solving the Problems

An apparatus for controlling an electric compressor of the present invention accomplished to achieve the above object is an apparatus for controlling an electric compressor which drives the compressor constituting an air conditioner by using a motor, characterized in that processing performed by the apparatus includes processing for avoiding motor overload caused by a pressure difference of a refrigerant between the inlet side and the outlet side of the compressor by keeping the number of revolutions of the motor not higher than a preset first number of revolutions when the actuation of the motor is started; and processing for increasing the number of revolutions of the motor to a second number of revolutions not lower than the first number of revolutions.

At this time, in the processing for avoiding motor overload caused by the pressure difference of the refrigerant, by keeping the number of revolutions of the motor not higher than the first number of revolutions, the refrigerant liquefied on the outlet side of the compressor can be pushed out. Thereby, even in the case where the pressure difference is large, the motor can be actuated.

In the processing for avoiding motor overload caused by the pressure difference of the refrigerant, it is preferable that a rate of rise S1 of the number of revolutions of the motor be set lower than a rate of rise S2 of the number of revolutions of the motor in the processing for increasing the number of revolutions of the motor to the second number of revolutions. The rate of rise S1 includes zero. Specifically, in the processing for avoiding motor overload caused by the pressure difference of the refrigerant, a time period for which the number of revolutions of the motor is kept low is provided.

It is preferable that the apparatus further perform processing for monitoring whether a current supplied to drive the motor exceeds a preset threshold value.

Immediately after the actuation of the motor has been started, the number of revolutions of the motor can be increased at a rate of rise S3 higher than the rate of rise S1 of the number of revolutions of the motor in the processing for avoiding motor overload caused by the pressure difference of the refrigerant. Also, the configuration may be such that, in the processing for monitoring the current supplied to drive the motor, when the current exceeds the preset threshold value, the processing shifts to the processing for avoiding motor overload caused by the pressure difference of the refrigerant.

That is to say, in the normal time, the compressor is actuated by increasing the number of revolutions of the motor at a high rate of rise S3, and when overcurrent flows in the motor, the processing for avoiding motor overload caused by the pressure difference of the refrigerant is performed. Thereby, in the case where the pressure difference is small, the compressor can be actuated rapidly by increasing the number of revolutions of the motor at a high rate of rise S3.

In the case where the air conditioner is mounted on a vehicle, the present invention can be applied especially effectively.

In the present invention, there can also be provided a method for controlling an electric compressor which drives the compressor constituting an air conditioner by using a motor, characterized by including a time period for keeping a rate of rise of the number of revolutions of the motor not higher than a preset rate of rise S1 when the actuation of the motor is started; and a time period for increasing the number of revolutions of the motor to a preset number of revolutions by taking the rate of rise of the number of revolutions of the motor as a rate of rise S2 not lower than the rate of rise S1.

ADVANTAGES OF THE INVENTION

According to the present invention, in actuating the motor of the electric compressor, even in the case where a large pressure difference arises between the inlet side and the outlet side of the compressor, by actuating the motor at a low number of revolutions, such action as to push out the liquefied refrigerant can be accomplished, and the motor can be actuated. As a result, the electric compressor can be actuated surely. Moreover, by changing the rate of rise of the number of revolutions of the motor from S1 to S2, the number of revolutions of the motor can be caused to reach the required number of revolutions as early as possible while surely performing the actuation, so that the air conditioner can be actuated rapidly.

In addition, the above-described configuration can achieve effects of reduction in weight, cost, and assembling time and improvement in reliability resulting from the reduction in the number of parts because a differential pressure sensor need not be used.

DESCRIPTION OF SYMBOLS

10 . . . electric compressor, 11 . . . compressor body, 11*a* . . . inlet side, 11*b* . . . outlet side, 12 . . . motor, 13 . . . control board, 14 . . . switching element, 15 . . . control unit, 17 . . . current detecting circuit, 20 . . . overcurrent protecting section, 21 . . . actuation control section

BEST MODE FOR CARRYING OUT THE INVENTION

The present invention will now be described in detail based on an embodiment shown in the accompanying drawings.

Figure 1:
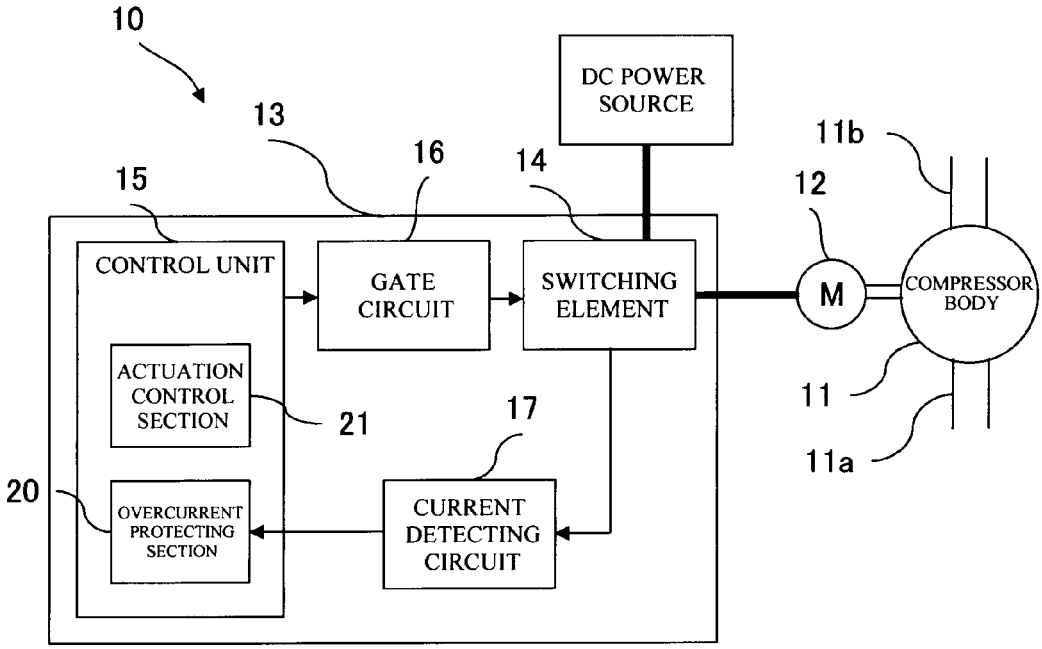
FIG. 1 is a block diagram showing a schematic configuration of an electric compressor in accordance with an embodiment.

FIG. 1 is a block diagram for explaining a configuration of an electric compressor 10 for an automotive air conditioner in accordance with the embodiment.

As shown in FIG. 1, the electric compressor 10 includes a compressor body 11 for compressing a refrigerant, a motor 12 for driving the compressor body 11, and a control board 13 for rotating the motor 12.

The control board 13 includes a switching element 14 for converting a voltage supplied from a dc power source into ac voltage, a control unit 15 consisting of a microcomputer for controlling the operation of the switching element 14, and a gate circuit 16. When the gate circuit 16 is driven by the control of the control unit 15, and the drive signal thereof is input to the switching element 14, the switching element 14 is operated. Thereby, the voltage supplied from the dc power source is applied to the motor 12 of the electric compressor 10 as a three-phase alternating current, by which the motor 12 is rotationally driven.

The control board 13 includes a current detecting circuit 17 for detecting a current supplied to the switching element 14. The control unit 15 monitors a current supplied from the switching element 14 to the motor 12 based on a current value detected by the current detecting circuit 17. To prevent overcurrent from being supplied to the motor 12 when the current value exceeds a preset detection value, the control unit 15 has, as a function, an overcurrent protecting section 20 for stopping the supply of current to the motor 12.

Also, the control unit 15 has, as a function, an actuation control section 21 for controlling a current supplied to the switching element 14 when the motor is actuated.

In the actuation control section 21, a preset current is supplied to the switching element 14 to actuate the motor 12 (hereinafter, referred to as a normal actuation mode). When, in the overcurrent protecting section 20, the current supplied to the motor 12 does not exceed the threshold value, and the motor 12 is actuated while it is not judged that the current is overcurrent, the motor 12 is rotated at a predetermined number of revolutions at the time of steady operation to compress the refrigerant by the compressor body 11. On the other hand, when, in the overcurrent protecting section 20, as a result of actuation, it is judged that the current supplied to the motor 12 exceeds the threshold value and is overcurrent, the actuation of the motor 12 is suspended, and a lower current is supplied to restart the motor 12 (hereinafter, referred to as a restart mode). When the motor 12 is restarted, the supplied current is increased gradually by being changed stepwise or linearly.

Figure 2A:
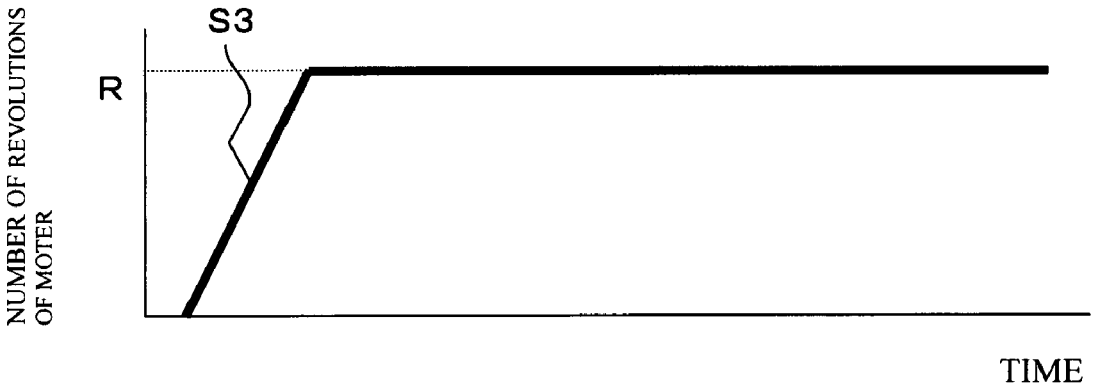
FIGS. 2A, 2B and 2C are graphs showing pattern examples of changes of number of revolutions of a motor at the time when the motor is actuated in an actuation control section.
Figure 2B:
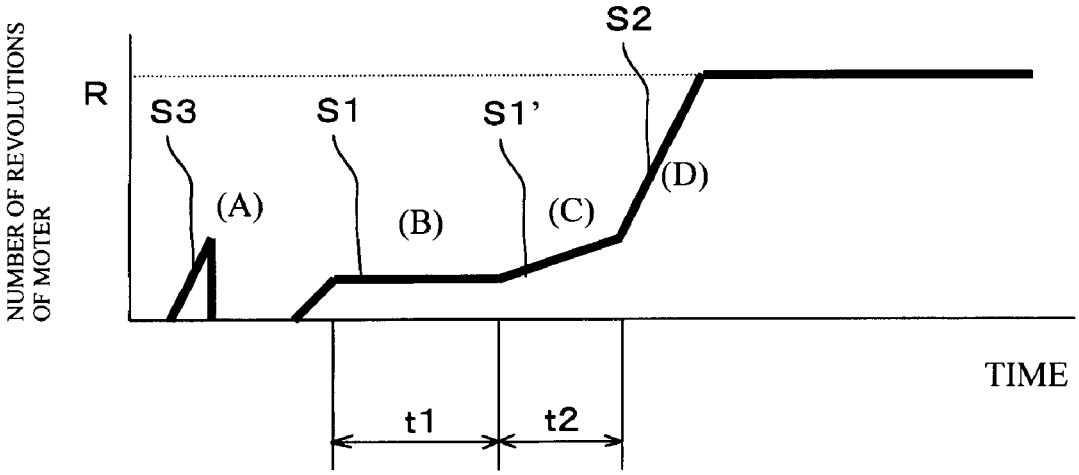
Figure 2C:
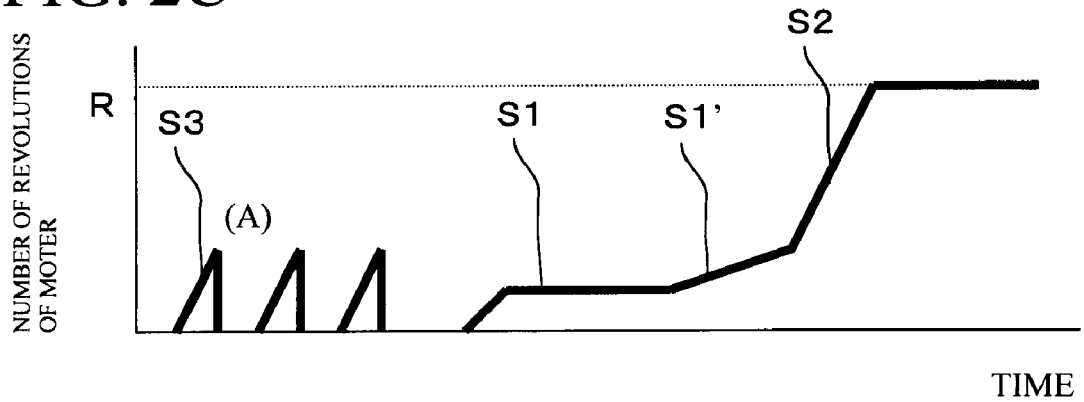

FIGS. 2A, 2B and 2C show examples of changes of number of revolutions of the motor 12 at the time when the motor is actuated, which is caused by the above-described control in the actuation control section 21.

As shown in FIG. 2A, at the normal time, when a current is supplied to the switching element 14 to actuate the motor 12 in the normal mode, the number of revolutions of the motor 12 increases until reaching a predetermined number of revolutions R at the time of steady operation. The rate of rise of the number of revolutions at this time is taken as S3.

When the pressure difference between an inlet side 11*a* and an outlet side 11*b* of the compressor body 11 is large, as shown in FIG. 2B, when the motor 12 is actuated in the normal mode, the number of revolutions of the motor 12 does not increase because the resistance in the compressor body 11 at the time when the compressor body 11 is going to compress the refrigerant is high due to the pressure difference. In process of increasing the number of revolutions, the overcurrent protecting section 20 detects overcurrent, and the actuation of the motor 12 is suspended (refer to (A) in FIG. 2B).

Subsequently, in the actuation control section 21, the motor 12 is restarted in the restart mode. At this time, by changing the supplied current stepwise, the number of revolutions of the motor 12 is increased gradually. In this embodiment, in a time period (first time period) from when the restart mode is started to when predetermined time tl has elapsed, a current is supplied so that the rate of rise 51 of the number of revolutions of the motor 12 is made not higher than the aforementioned rate of rise S3, and the number of revolutions of the motor 12 is kept not larger than a fixed number of revolutions (first number of revolutions) (refer to (B) in FIG. 2B). The purpose in this time period is to rotate the motor 12 in the state in which the number of revolutions is kept to push out a refrigerant that may be in a liquid state on the outlet side 11*b* of the compressor body 11.

After the first time period has finished, in a time period (second time period) until preset time t2 has elapsed, a current is supplied so that the number of revolutions of the motor 12 increases at a rate of rise Sl' lower than the rate of rise S3 in the normal mode (refer to (C) in FIG. 2B). The purpose in this time period is to completely push out the refrigerant in a liquid state on the outlet side 1lb of the compressor body 11 and to obtain the number of revolutions at the time of steady operation in a shorter period of time. After the second time period has finished, a current is supplied so that the number of revolutions of the motor 12 increases at the rate of rise S2 that is similar to the rate of rise in the normal mode until reaching the number of revolutions at the time of steady operation (second number of revolutions) R (refer to (D) in FIG. 2B).

That is to say, in the first time period, the refrigerant that may be in a liquid state is pushed out, and subsequently, in the second time period, the number of revolutions of the motor 12 is increased gradually in such a state that the current supplied to the motor 12 is not overcurrent. In the third time period, after the pressure difference has become equivalent to that at the normal start time, the number of revolutions of the motor 12 is increased rapidly at the rate of rise similar to that in the normal mode.

Needless to say, the pattern of change in the number of revolutions of the motor 12 in the restart mode shown in FIG. 2B is only an example. If the motor 12 can surely be actuated from a state in which a pressure difference is present and moreover the number of revolutions can reach the predetermined number of revolutions as early as possible, any pattern may be adopted.

Also, as shown in FIG. 2C, in the case where overcurrent is detected when the motor 12 is actuated in the normal mode, after the actuation in the normal mode has been tried a plurality of times, the motor 12 may be actuated in the restart mode.

Hereunder, a flow of processing for carrying out the above-described control in the actuation control section 21 is explained with reference to FIG. 3.

Figure 3:
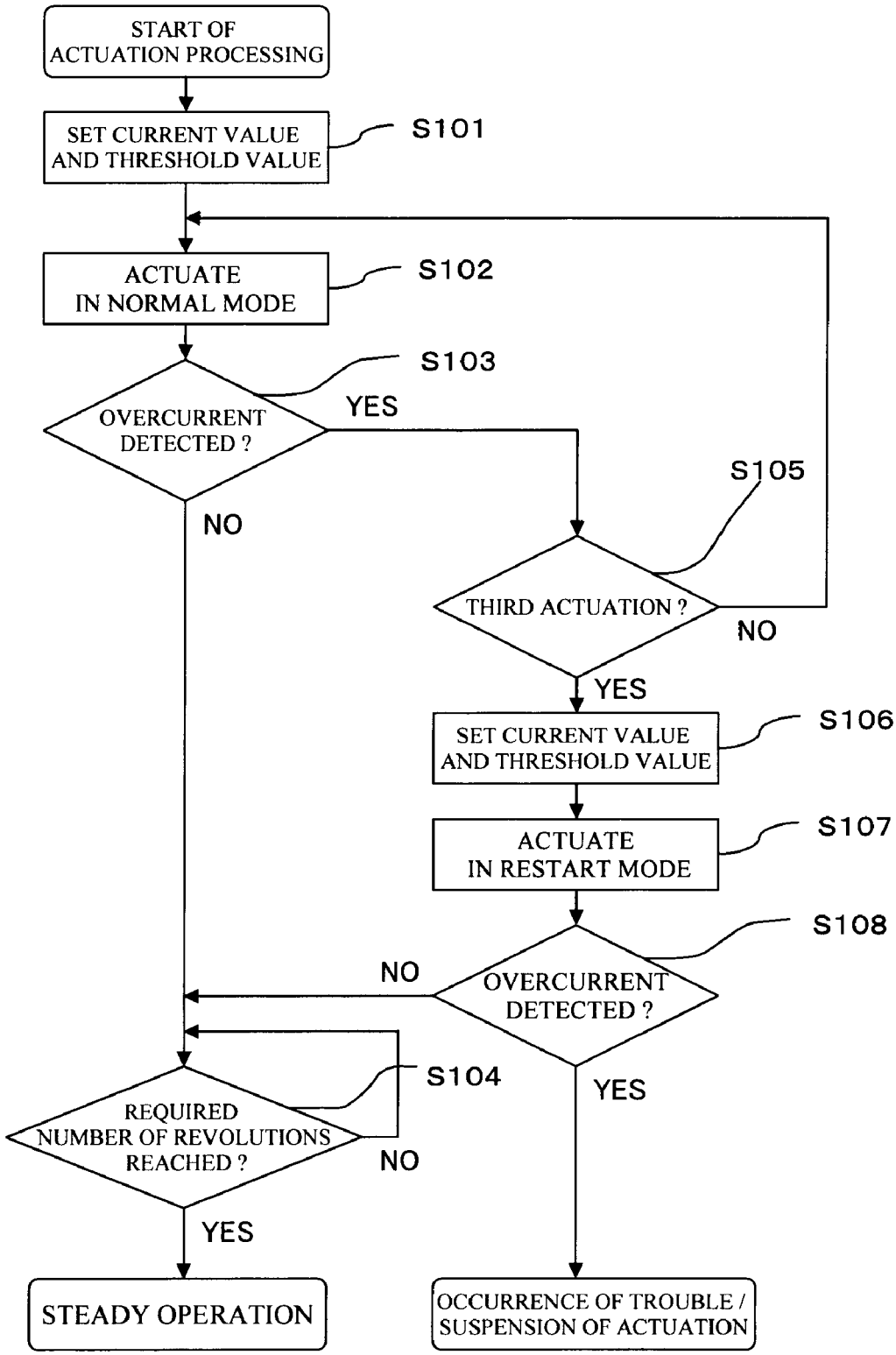
FIG. 3 is a flowchart showing a flow of processing at the time when the motor is actuated in an actuation control section.

As shown in FIG. 3, when a command of actuation is input to the control unit 15 from a host control circuit for controlling the entire operation of the automotive air conditioner, in the control unit 15, the actuation processing of the electric compressor 10 is started. At this time, the control unit 15 receives a command of a required number of revolutions of the motor 12 (that is, the predetermined number of revolutions R at the time of steady operation) from the host control circuit.

First, in the control unit 15, a current value in accordance with the required number of revolutions of the motor 12 commanded from the host control circuit is set based on a preset table (Step S101). Along with this, a threshold value for overcurrent protection corresponding to the set current value is set.

Next, in the actuation control section 21 of the control unit 15, a current having a magnitude having been set in Step S101 is supplied to the switching element 14 to actuate the motor 12 in the normal mode (Step S102).

After the motor 12 has been actuated, while monitoring whether overcurrent is detected in the overcurrent protecting section 20 (Step S103), the control waits until the number of revolutions of the motor 12 reaches the required number of revolutions (Step S104), and when the required number of revolutions (number of revolutions R) is reached, the actuation processing is finished, thereafter the control going to steady operation.

After the motor 12 has been actuated, if overcurrent is detected in the overcurrent protecting section 20 in Step S103, the control returns to Step S102, and the motor 12 is actuated again in the normal mode. This actuation of the motor 12 in the normal mode is repeated until preset times (for example, three times in this embodiment; a pattern corresponding to FIG. 2C) are reached (Step S105).

If the number of revolutions of the motor 12 reaches the required number of revolutions without detecting overcurrent in the overcurrent protecting section 20 during the time when the actuation in the normal mode is repeated until the preset times are reached (Step S103, S104), the control goes to steady operation as it is.

In the case where overcurrent is detected in the overcurrent protecting section 20 even if the actuation in the normal mode is repeated until the preset times are reached, the control goes to actuation in the restart mode.

For this purpose, first, a current value corresponding to the pattern of change in the number of revolutions of the motor 12 in the restart mode (refer to FIGS. 2B and 2C) is set (Step S106). Along with this, a threshold value for overcurrent protection corresponding to the set current value is set.

Next, in the actuation control section 21 of the control unit 15, a current having a magnitude having been set in Step S106 is supplied to the switching element 14 to actuate the motor 12 in the restart mode (Step S107). At this time, to change the number of revolutions of the motor 12 in a pattern as shown in FIG. 2C, in the actuation control section 21, a current having a predetermined magnitude is supplied to the switching element 14 in each of the first, second, and third time periods while monitoring the elapsed time by using a timer.

After the motor 12 has been actuated in the restart mode, while monitoring whether overcurrent is detected in the overcurrent protecting section 20 (Step S108), the control waits until the number of revolutions of the motor 12 reaches the required number of revolutions (Step S104), and when the required number of revolutions is reached, the control goes to steady operation.

On the other hand, after the motor 12 has been actuated, if overcurrent is detected in the overcurrent protecting section 20 in Step S108, it is judged that any trouble has occurred in the compressor body 11 for any cause other than pressure difference, the actuation of the motor 12 is suspended, and the occurrence of trouble is notified to the host control circuit. Needless to say, at this time as well, when overcurrent is detected in Step S108, the actuation of the motor 12 in the restart mode may be repeated until the preset times are reached.

By actuating the motor 12 in this manner, even when a pressure difference arises between the inlet side 11*a* and the outlet side 11*b* of the compressor body 11, the motor 12 is actuated in the restart mode at a number of revolutions lower than that in the normal mode, by which the motor 12 can be actuated. As a result, even in the case where the refrigerant has been liquefied, for example, on the outlet side 11*b* of the compressor body 11, such action as to push out the liquefied refrigerant can be performed immediately after the compressor body 11 has been actuated, so that the electric compressor 10 can surely actuated.

Moreover, in the restart mode, by increasing the number of revolutions of the motor 12 while changing stepwise or linearly, the number of revolutions of the motor 12 can be caused to reach the required number of revolutions as early as possible while surely performing the actuation, so that the air conditioner can be actuated rapidly.

In addition, the above-described configuration achieves effects of reduction in weight, cost, and assembling time and improvement in reliability resulting from the reduction in the number of parts because a differential pressure sensor need not be used.

In the above-described embodiment, the examples of patterns of change in the number of revolutions of the motor 12 in the restart mode are shown in FIGS. 2A, 2B and 2C. However, it is a matter of course that any pattern other than those shown in FIGS. 2A, 2B and 2C may be used, or a plurality of kinds of patterns may be used by being changed over.

Further, the configuration may be such that the operating conditions (the operation/stop state etc. of the compressor body 11) at the time when the air conditioner is previously stopped, the time elapsed from the stopping, and the like are stored, and the pattern of change in the number of revolutions of the motor 12 in the restart mode is changed over according to the stored operating conditions.

Also, in the above-described embodiment, the configuration is such that when the actuation in the normal mode becomes a failure, the actuation shifts to the restart mode. However, the present invention is not limited to this configuration. The motor 12 can be actuated in a pattern similar to the restart mode, for example, as shown in FIG. 2(*b*) from the first actuation time.

Besides, regarding the configuration, the control method, and the like of the electric compressor 10, the configurations described in the above embodiment can be selected or can be changed appropriately without departing from the spirit and scope of the present invention.

The invention claimed is:

1. An apparatus for controlling an electric compressor which drives the compressor constituting an air conditioner by using a motor, characterized in that processing performed by the apparatus comprises:

processing for avoiding motor overload caused by a pressure difference of a refrigerant between the inlet side and the outlet side of the compressor by keeping the number of revolutions of the motor not higher than a preset first number of revolutions when the actuation of the motor is started; and processing for increasing the number of revolutions of the motor to a second number of revolutions not lower than the first number of revolutions, wherein, in the processing for avoiding motor overload caused by the pressure difference of the refrigerant, a rate of rise S1 of the number of revolutions of said motor is set lower than a rate of rise S2 of the number of revolutions of said motor in the processing for increasing the number of revolutions of said motor to the second number of revolutions, and said apparatus further performs processing for monitoring whether a current supplied to drive said motor exceeds a preset threshold value, immediately after the actuation of said motor is started, the number of revolutions of said motor is increased at a rate of rise S3 higher than the rate of rise S1 of the number of revolutions of said motor in said processing for avoiding motor overload caused by the pressure difference of said refrigerant, and in said processing for monitoring the current supplied to drive the motor, when the current exceeds the preset threshold value, said processing shifts to said processing for avoiding motor overload caused by the pressure difference of said refrigerant.

2. The apparatus for controlling an electric compressor according to claim 1, characterized in that, in the processing for avoiding motor overload caused by the pressure difference of the refrigerant, by keeping the number of revolutions of the motor not higher than the first number of revolutions, the refrigerant liquefied on the outlet side of the compressor is pushed out.

3. The apparatus for controlling an electric compressor according to claim 1, characterized in that the air conditioner is mounted on a vehicle.

4. A method for controlling an electric compressor which drives the compressor constituting an air conditioner by using a motor, characterized by comprising:

a time period for keeping a rate of rise of the number of revolutions of the motor not higher than a preset rate of rise S1 when the actuation of the motor is started;

a time period for increasing the number of revolutions of the motor to a preset number of revolutions by taking the rate of rise of the number of revolutions of the motor as a rate of rise S2 not lower than the rate of rise S1, wherein immediately after the actuation of the motor has been started, the number of revolutions of the motor is increased at a rate of rise S3 not lower than the rate of rise S1; and a time period for increasing the number of revolutions of the motor at a rate of rise S1 lower than the rate of rise S3 between the time period for keeping the rate of rise of the number of revolutions of the motor and the time period for increasing the number of revolutions of the motor.

* * * * *